US011583120B2

(12) United States Patent
Malcolm

(10) Patent No.: US 11,583,120 B2
(45) **Date of Patent: *Feb. 21, 2023**

(54) UTENSIL CONFIGURED TO INTERACT WITH FOOD ITEMS

(71) Applicant: Constructive Eating, Ann Arbor, MI (US)

(72) Inventor: Carter T. Malcolm, Ann Arbor, MI (US)

(73) Assignee: Constructive Eating, Inc., Ann Arbor, MI (US)

( * ) Notice: Subject to any disclaimer, the term of this patent is extended or adjusted under 35 U.S.C. 154(b) by 52 days.

This patent is subject to a terminal disclaimer.

(21) Appl. No.: 17/216,035

(22) Filed: Mar. 29, 2021

(65) Prior Publication Data

US 2021/0212487 A1 Jul. 15, 2021

Related U.S. Application Data

(63) Continuation of application No. 16/256,658, filed on Jan. 24, 2019, now Pat. No. 10,959,554, which is a continuation of application No. 29/665,692, filed on Oct. 5, 2018, now Pat. No. Des. 871,169, and a continuation of application No. 29/663,401, filed on Sep. 14, 2018, now Pat. No. Des. 871,168, and a continuation of application No. 29/630,057, filed on Dec. 19, 2017, now Pat. No. Des. 840,769.

(51) Int. Cl.

| | |
|---|---|
| ***A47G 21/02*** | (2006.01) |
| ***A47G 21/04*** | (2006.01) |
| *B26B 3/02* | (2006.01) |

(52) U.S. Cl.

CPC ..... *A47G 21/02* (2013.01); *A47G 21/023* (2013.01); *A47G 21/04* (2013.01); *A47G 2400/025* (2013.01); *A47G 2400/10* (2013.01); *B26B 3/02* (2013.01)

(58) Field of Classification Search

None

See application file for complete search history.

(56) References Cited

U.S. PATENT DOCUMENTS 1,528,679 A * 3/1925 Macleod ..... A47G 21/023 30/323

2,243,236 A * 5/1941 Walsh ..... A47G 21/02 254/133 R (Continued)

*Primary Examiner* — Hwei-Siu C Payer

(74) *Attorney, Agent, or Firm* — Dickinson Wright PLLC

(57) ABSTRACT

A utensil configured to interact with food items includes a main body portion, a handle portion extending in a first direction from the main body portion, and a food manipulating portion extending from the main body portion in a second direction, wherein the food manipulating portion of the utensil is configured to interact with food. The utensil may also include a plurality of legs extending from the main body portion in a third direction to support the utensil on a support surface. The plurality of legs elevate the handle portion, main body portion and food manipulating portion from the support surface such that the handle portion, main body portion, and food manipulating portion are not in contact with the support surface when the utensil is placed on the support surface with the legs supporting the utensil from the support surface.

20 Claims, 6 Drawing Sheets

(56) References Cited

U.S. PATENT DOCUMENTS 2,789,349 A * 4/1957 Lee ..... B26B 3/02 30/295
3,968,591 A * 7/1976 Pearson, Jr. ..... A47G 21/04 D7/300.2
4,159,839 A * 7/1979 Sigler ..... A47G 21/02 30/142
D291,046 S * 7/1987 Johnson ..... D7/653
D294,391 S * 2/1988 Woo ..... D24/116
4,976,646 A * 12/1990 Hull ..... A63H 3/14 446/77
5,187,829 A * 2/1993 Atkins ..... A46B 15/0097 D4/125
D339,964 S * 10/1993 Knox ..... D7/642
D347,148 S * 5/1994 Harrison ..... D4/107
D351,310 S * 10/1994 Burdick ..... D7/401.2
5,353,464 A * 10/1994 Atkins ..... A46B 5/00 D4/125
D356,928 S * 4/1995 Brown ..... D4/107
5,590,472 A * 1/1997 Yaakov ..... A47G 21/02 30/298.4
D389,711 S * 1/1998 Henry ..... D21/576
D405,670 S * 2/1999 Wysopal ..... D8/38
D419,306 S * 1/2000 Hansen ..... D4/125
6,105,254 A * 8/2000 Crane ..... A47G 21/04 30/326
6,105,259 A * 8/2000 Meyers ..... A47G 21/02 30/326
6,363,568 B1 * 4/2002 Harrison ..... A46B 15/0097 15/176.1
6,463,662 B1 * 10/2002 Coscia ..... A47G 21/181 D7/300.2
D470,370 S * 2/2003 Arnold ..... D8/34
D554,439 S * 11/2007 Malcolm ..... D7/653
D554,440 S * 11/2007 Malcolm ..... D7/653
D639,617 S * 6/2011 Malcolm ..... D7/653
D661,954 S * 6/2012 Malcolm ..... D7/653
8,286,956 B2 * 10/2012 Pearl ..... A47J 47/005 269/302.1
D716,107 S * 10/2014 Skolnik ..... D7/642
D736,039 S * 8/2015 Donovan ..... D7/642
D739,185 S * 9/2015 Donovan ..... D7/645
D840,769 S * 2/2019 Malcolm ..... A47G 21/023 D7/654
10,413,103 B1 * 9/2019 Balanchi ..... A47G 21/023
D871,168 S * 12/2019 Malcolm ..... D7/654
D871,169 S * 12/2019 Malcolm ..... D7/654
10,959,554 B2 * 3/2021 Malcolm ..... A47G 21/023
11,324,345 B2 * 5/2022 Oehlert ..... A47G 21/04
2004/0237311 A1 * 12/2004 Brown ..... A47G 21/181 30/141
2005/0028386 A1 * 2/2005 Hughes ..... A47G 21/02 30/298.4
2008/0134520 A1 * 6/2008 Kormandel ..... A47G 21/02 30/142
2009/0077812 A1 * 3/2009 Malcolm ..... A47G 21/02 30/142
2011/0068111 A1 * 3/2011 Malcolm ..... A47G 19/02 220/574
2012/0297628 A1 * 11/2012 Rayko ..... A47G 21/02 30/323
2015/0282655 A1 * 10/2015 Donovan ..... A47G 19/06 30/142
2019/0183272 A1 * 6/2019 Malcolm ..... A47G 21/023
2021/0212487 A1 * 7/2021 Malcolm ..... A47G 21/04

* cited by examiner

UTENSIL CONFIGURED TO INTERACT WITH FOOD ITEMS

CROSS-REFERENCE TO RELATED APPLICATIONS

This application is a continuation of U.S. patent application Ser. No. 16/256,658, filed Jan. 24, 2019, now U.S. Pat. No. 10,959,554, which is a continuation of U.S. Design Patent Application Nos. 29/630,057, filed Dec. 19, 2017, now U.S. Pat. No. D840,769, 29/663,401, filed Sep. 14, 2018, now U.S. Pat. No. D871,168 and 29/665,692, filed Oct. 5, 2018, now U.S. Pat. No. D871,169, each of which are hereby incorporated by reference in their entirety.

BACKGROUND

1. Field of the Invention

The present invention generally relates to utensils configured to interact with food items.

2. Description of Related Art

Very young children usually begin self-feeding by using their hands to bring food from a plate or tray to their mouths. As children develop, they eventually begin using utensils to transport food from the plate to their mouths. However, as many caregivers have experienced, children typically can go through periods in their development where they become picky eaters. Parents have utilized numerous methodologies to encourage their child to eat.

One such methodology involves encouraging the child to eat by animating the food so that the child eats the food so as to play along with the animation. One example of this type of animation is an airplane type animation wherein the caregiver scoops the food with the utensil and makes airplane sounds. Eventually, the caregiver then provides the food on the utensil to the child with the hopes that the child, with the excitement of the airplane activity, eats the food willingly.

In addition to difficulties with getting children to eat the food provided to them, utensils are generally difficult for children to manipulate and handle. In addition, these utensils are generally miniaturized versions of normally sized utensils. These miniaturized versions of these normally sized utensils while smaller in size, generally do not contain features that encourage a child to use these utensils. As such, children may find that miniaturized versions of normal and undistinguishable utensils are boring to use and avoid utilizing them.

SUMMARY

In one example, a utensil configured to interact with food items includes a main body portion, a handle portion extending in a first direction from the main body portion, and a food manipulating portion extending from the main body portion in a second direction. The food manipulating portion of the utensil may be configured to interact with food;

In another example, the utensil may also include four legs extending from the main body portion in a third direction to support the utensil on a support surface, wherein the at least four legs elevate the handle portion, main body portion and food manipulating portion from the support surface such that the handle portion, main body portion, and food manipulating portion are not in contact with the support surface when the utensil is placed on the support surface with the legs supporting the utensil from the support surface. The third direction may be substantially perpendicular to one of the first direction and second direction.

In yet another example, the utensil may also include at least one leg protrusion feature extending from at least one of the legs in the third direction. The at least one leg protrusion feature may have a gripping surface for gripping the support surface.

In still another yet example, the utensil may also include at least one protrusion feature extending from either the main body portion or the handle portion in a fourth direction substantially opposite the third direction. The fourth direction may be substantially perpendicular to one of the first direction and second direction.

In yet another example, the main body portion may be made of a first material and the at least one protrusion feature may be made of a second material, wherein the first material may be different than the second material.

The utensil may also include at least one body protrusion feature extending from the main body portion and at least one handle protrusion feature extending from the handle portion in the fourth direction, the fourth direction generally opposing the third direction.

In another example, a utensil configured to interact with food items may include a main body portion, a handle portion extending in a first direction from the main body portion, the first direction defining a first axis, and a food manipulating portion extending from the main body portion in a second direction, wherein the food manipulating portion of the utensil may be configured to interact with food. The utensil in this example may also include a plurality of legs extending from the main body portion in a third direction to support the utensil on a support surface and a protrusion feature formed on a surface the utensil, the protrusion feature being adjacent to the main body portion and extending at a second axis. The angle between the first axis may be between 1 degree and 90 degrees or between 5 degree and 45 degrees.

In yet another example, the protrusion feature may be at least partially between either (a) the main body portion and the handle portion or (b) the main body portion and the food manipulating portion. In one example, the protrusion feature may be a head of an animal, such as a dinosaur.

In still yet another example, the utensil includes a main body portion, a handle portion extending in a first direction from the main body portion, and a food manipulating portion extending from the main body portion in a second direction, wherein the food manipulating portion of the utensil may be configured to interact with food. The utensil in this example may also include a plurality of legs extending from the main body portion in a third direction to support the utensil on a support surface. The third direction may be substantially perpendicular to one of the first direction and second direction. The legs may be configured such that the handle portion, main body portion, and food manipulating portion do not touch the support surface when the utensil is placed on the support surface with the legs supporting the utensil from the support surface.

In another example, the first direction substantially opposes the second direction and/or the third direction may be substantially perpendicular to both the first direction and second direction.

In yet another example, the at least one protrusion feature may extend from either the main body portion or the handle portion in a fourth direction substantially opposite the third direction. The fourth direction may be substantially perpendicular to one of the first direction and second direction and/or substantially perpendicular to both the first direction and second direction.

In still yet another example, the main body portion may be made of a first material and the at least one protrusion feature may be made of a second material, wherein the first material may be different than the second material. The second material may be softer than the first material.

In yet another example, the at least one body protrusion feature may extend from the main body portion and at least one handle protrusion feature may extend from the handle portion in the fourth direction, substantially opposite the third direction. In this example, the main body portion may be made of a first type of material and the at least one body protrusion feature and the at least one handle protrusion feature may be made of a second type of material. The second type of material may be softer than the first type of material.

In still yet another example, at least one body protrusion feature and the at least one handle protrusion feature may be connected to each other via at least one channel through the main body portion and handle portion.

In still yet another example, the at least one leg protrusion feature may extend from at least one of the legs in the third direction. The third direction may be substantially perpendicular to one of the first direction and second direction and/or be substantially perpendicular to both the first direction and second direction. The at least one leg protrusion feature may have a gripping surface for gripping to the support surface.

In yet another example, the at least one body protrusion feature may extend from the main body portion and at least one handle protrusion feature may extend from the handle portion in a fourth direction, the fourth direction generally opposing the third direction.

In another example, the at least one leg protrusion feature may be connected to the at least one handle protrusion feature and the at least one body protrusion feature via at least one channel through the main body portion.

In still yet another example, the food manipulating portion may include at least one of tines of a fork, head of a spoon, or a flat surface substantially perpendicular to the support surface.

Further objects, features, and advantages of this invention will become readily apparent to persons skilled in the art after a review of the following description, with reference to the drawings and claims that are appended to and form a part of this specification.

DETAILED DESCRIPTION

Figure 1A:
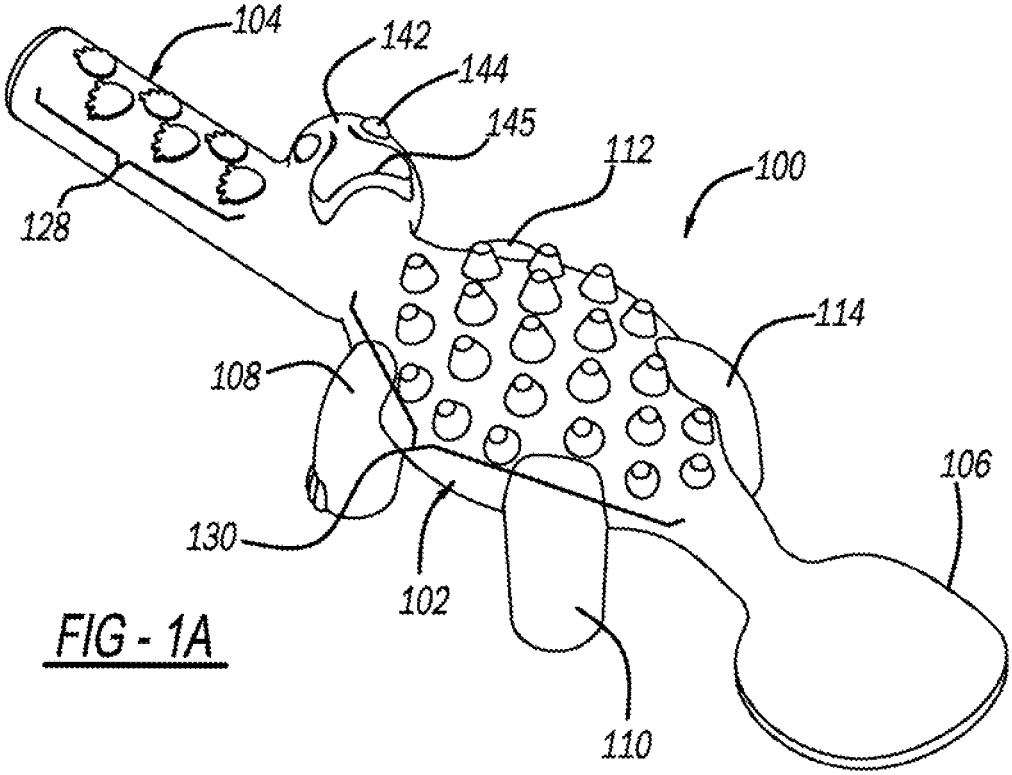
FIGS. 1A-1D illustrate one example of a utensil for interacting with food items with portions of the utensil shaped like an ankylosaurs.

It is first noted that FIGS. 1A-1D, 2A-2D, and 3A-3D each illustrate three different examples of a utensil for interacting with food items. FIGS. 1A-1D illustrate a spoon type utensil that has portions shaped like an Ankylosaurs. FIGS. 2A-2D show a fork type utensil with portions shaped like a Stegosaurus. FIGS. 3A-3D illustrate a pusher type utensil (for pushing food) having portions shaped like a Triceratops. Generally, like reference numerals have been used to refer to like elements. So, for example, handle portion 104 in FIGS. 1A-1D is similar to handle portions 204 and 304 in FIGS. 2A-2D and 3A-3D, respectively.

Additionally, it should be understood that while the utensils illustrated in the figures have portions shaped like different dinosaurs, it should be understood that the utensils may have portions shaped in any one of a number of different forms, including other dinosaurs, other animals or other objects. The invention is not just limited to just dinosaurs or animals in general. Additionally, it should be understood that while the food manipulating portions in these figures include a spoon, a fork, and a pusher, any one of a number of different food manipulating portions may be utilized, such as, but not limited to, sporks, knives, spatulas, or any implement for manipulating food.

Referring to FIGS. 1A-1D one example of the utensil 100 for interacting with food items is shown. Here, the utensil 100 is a spoon type utensil generally shaped like that of an Ankylosaurs. The utensil 100, as its basic components, includes a body portion 102, a handle portion 104, and a food manipulating portion 106, which, as stated earlier, is generally shaped so as to function as a spoon. However, as stated above, it should be understood that the food manipulating portion may any type of food manipulating portion. So, instead of a spoon as illustrated in FIGS. 1A-1D, the spoon could be replaced with a fork which is illustrated in FIGS. 2A-2D or a pusher which is illustrated in FIGS. 3A-3D or any other type of food manipulating device.

Figure 1B:
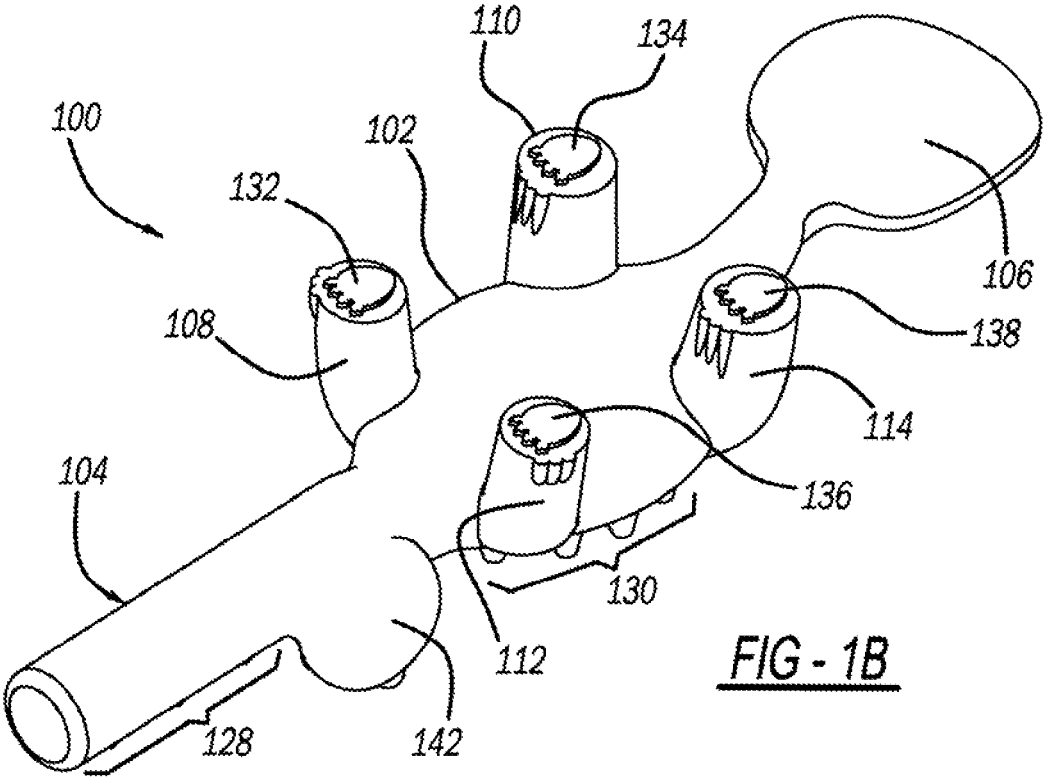
Figure 1C:
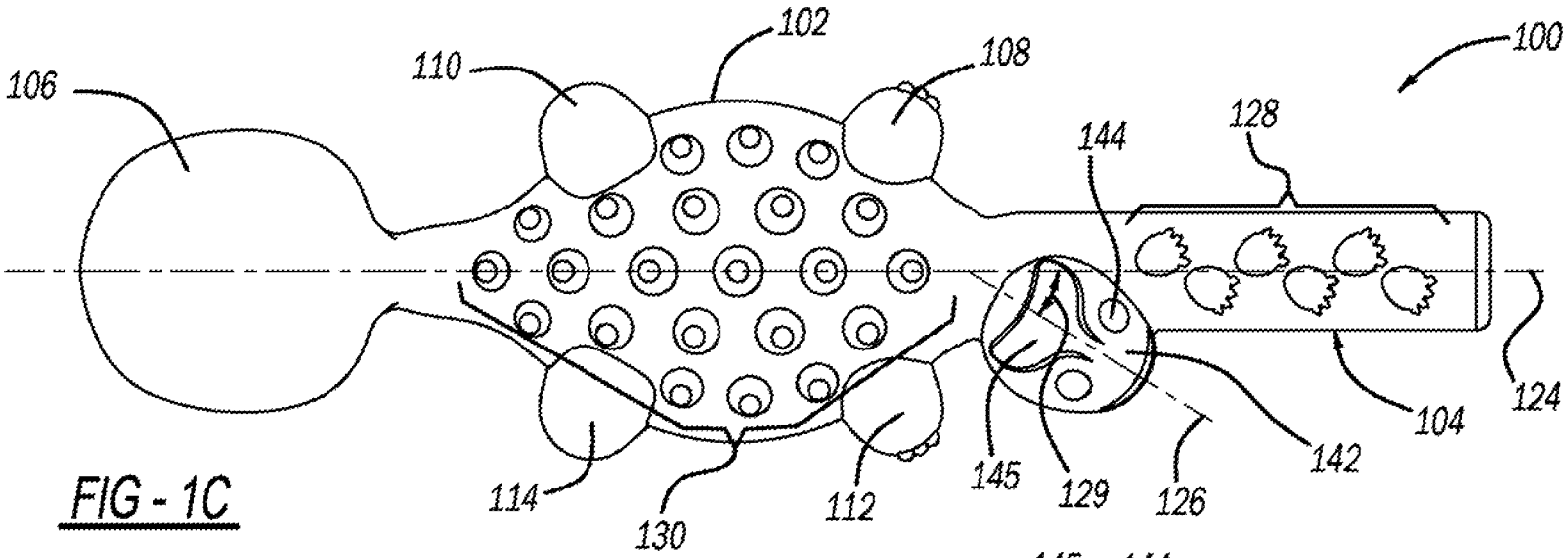
Figure 1D:
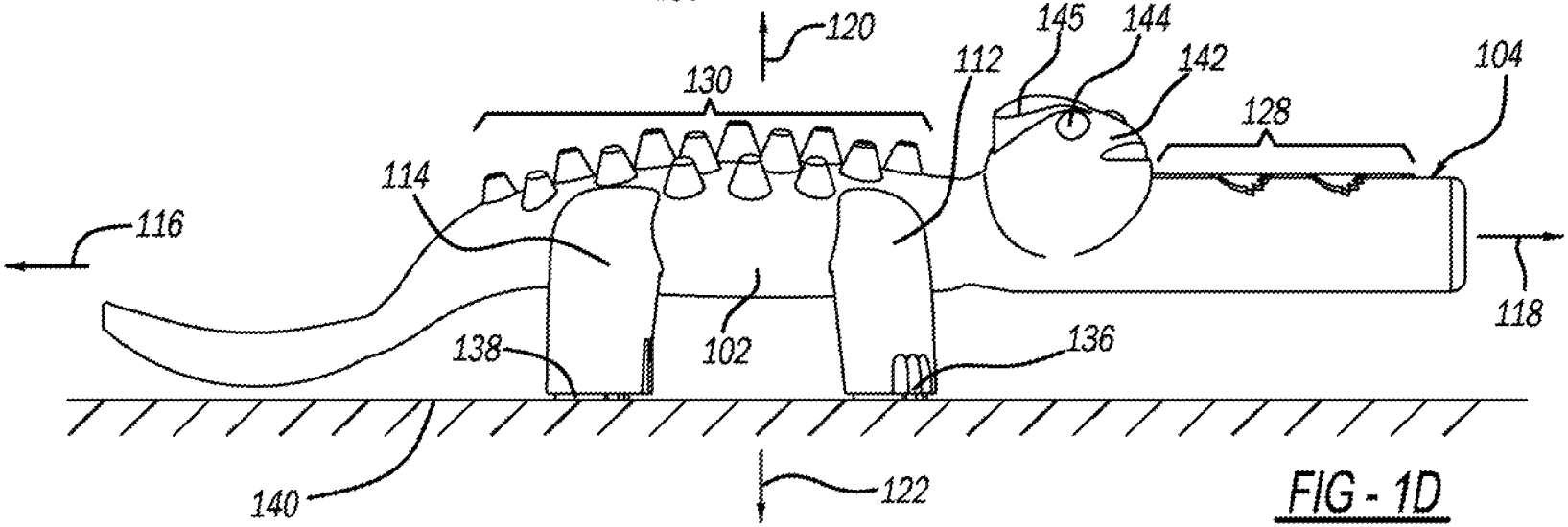
Figure 2A:
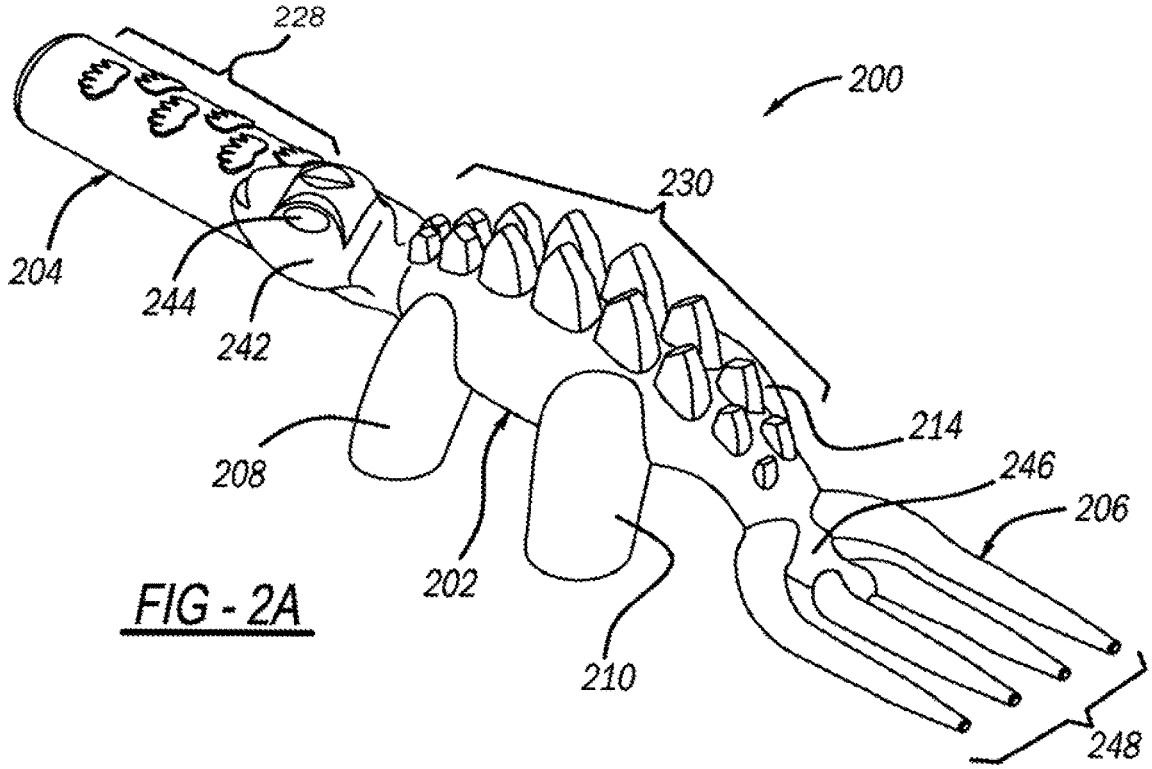
FIGS. 2A-2D illustrate another example of a utensil for interacting with food items with portions of the utensil shaped like a stegosaurus.
Figure 2B:
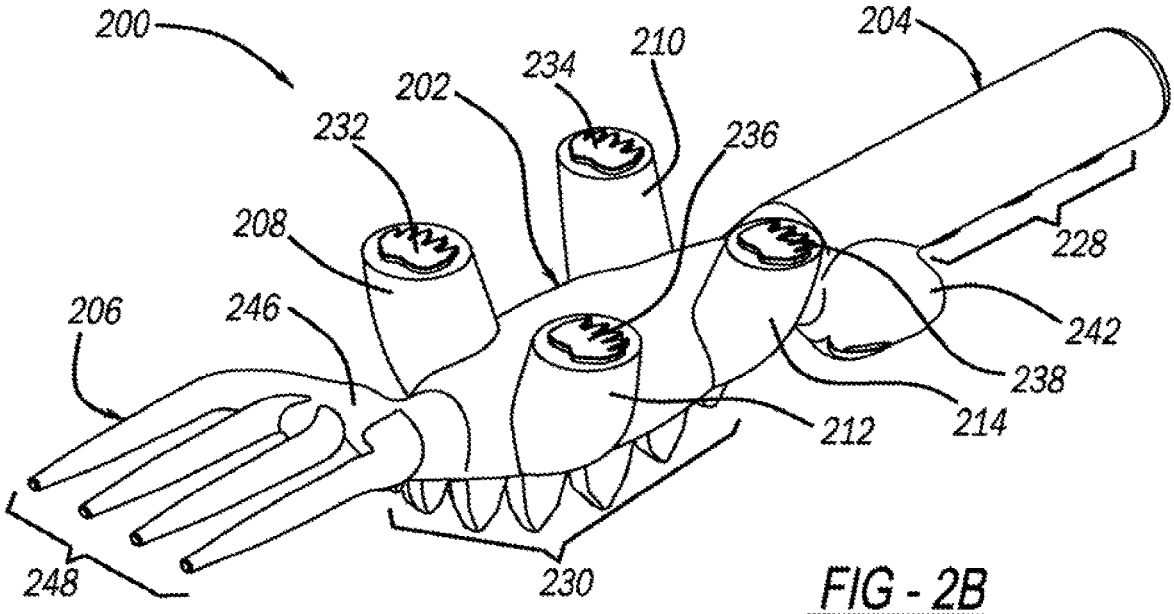
Figure 2C:
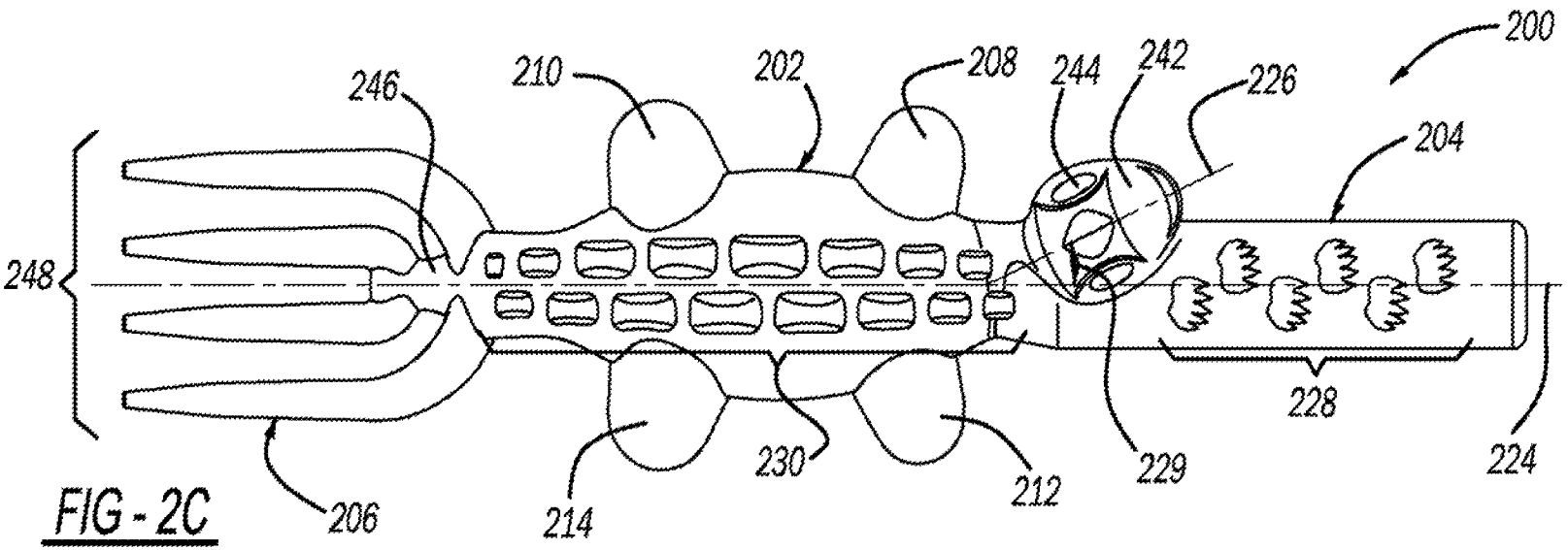
Figure 2D:
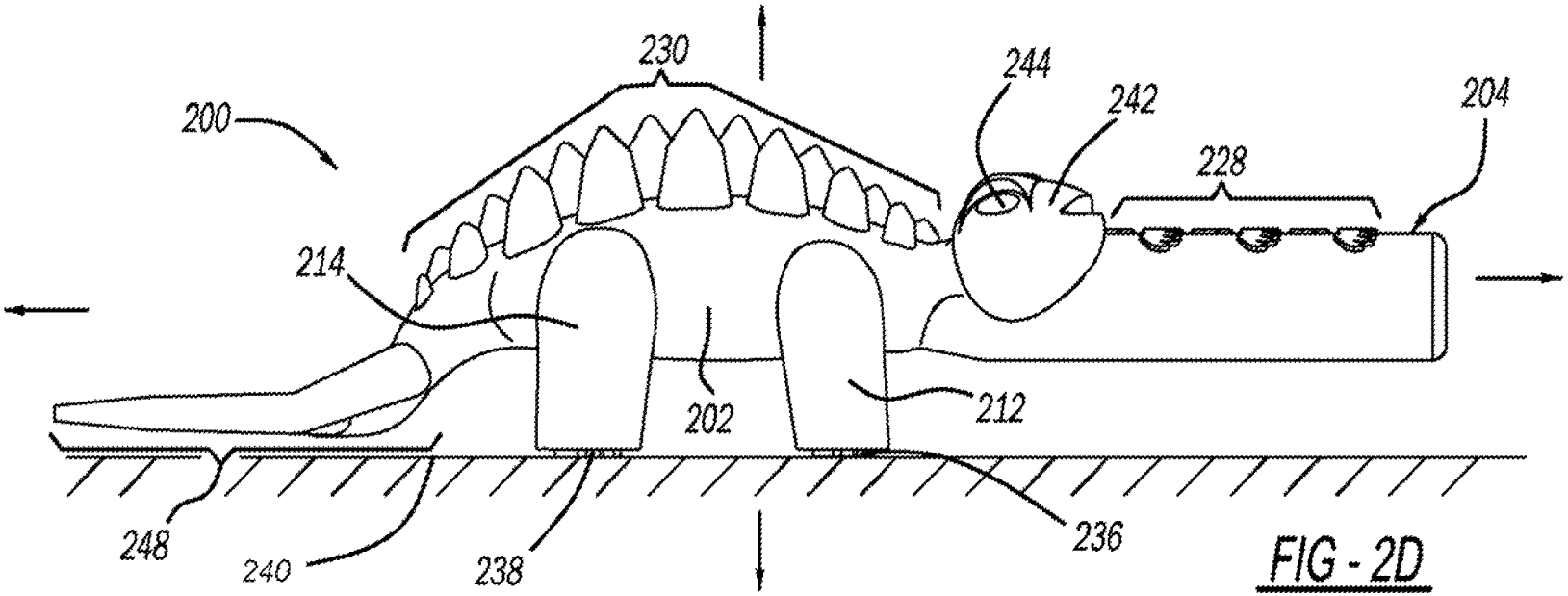

Generally, the handle portion 104 extends from the body portion 102 in a first direction as indicated by arrow 118 in FIG. 1D. The food manipulating portion 106 generally extends in a second direction as indicated by arrow 116 as best shown in FIG. 1D. Generally, the directions indicated by the arrows 116 and 118 oppose one another. However, it should be understood that these directions and angles may vary and do not need to generally oppose one another as shown.

Extending downward from the body portion 102 of the utensil 100 are legs 108, 110, 112, and 114. It should be understood that while this example only shows four legs extending from the body portion downward in a direction indicated by arrow 122, as best shown in FIG. 1D, the number of legs extending from the body portion could be any number, not just four as shown. The legs 108, 110, 112, and 114 are configured so that when the utensil 100 is placed on a surface 140 (as best shown in FIG. 1D) the legs 108, 110, 112, and 114 elevate the food manipulating portion 106, the handle portion 104, and/or the body portion 102 from the surface 140 when the utensil resting on the surface 140.

This elevation of the body portion 102, the handle portion 104, and/or the food manipulating portion 106 may be advantageous because children are fairly messy with utilizing utensils to eat food. Food that is attached to the body portion 102, handle portion 104, and/or food manipulating portion 106 will be elevated away from the surface 140, such as a table, thereby preventing the table from being dirtied with food that is attached to the utensil 100. The elevated body portion may also provide may also provide children with an experience that more closely simulates playing with a toy dinosaur with legs that extend down from an elevated body portion. It should also be understood that this example may be modified so that the food manipulating portion 106 may be in contact with the surface 140.

The legs 108, 110, 114, and 112 generally extend from the body portion 102 in the direction as indicated by arrow 122 that is substantially perpendicular to one of or possibly both of the directions indicated by arrows 116 and 118. As such, in this example, the legs 108, 110, 112, and 114 extend in the direction that is substantially perpendicular from the direction in which the food manipulating portion 106 and/or the handle portion 104 extends from the body portion 102. However, it is also contemplated that the legs may still extend downward at different angles than substantially perpendicular.

Additionally, the utensil 100 may have a protrusion feature 142 that may be shaped so as to resemble an animal, such as a dinosaur, with a dinosaur head or dinosaur tail or could be shaped to form any one of a number of different protrusion features. As best shown in FIG. 1C, the protrusion feature 142 generally extends from the body portion 102 along an axis 126. The handle portion 104 and the food manipulating portion 106 generally extend away from the body portion 102 as indicated by axis 124. As such, the protrusion feature 142 extends at an angle 129 that is defined by the axis 124 and the axis 126. This angle may be any one of a number of different angles what is typically between 1 and 90 degrees.

As stated before, the body portion has legs 108, 110, 112, and 114 generally extending downward from the body portion 102 in a direction indicated by arrow 122. In addition, the body portion 102 may have one or more spike protrusion features 130 extending in a direction generally opposing that of the legs 108, 110, 112, and 114. As shown in this example, the spike protrusion features 130 are a plurality of spikes that generally extend upward away from the body in the direction indicated by arrow 120 that is substantially opposite to the direction indicated by arrow 122. As such, the spike protrusion features 130 are also extending generally perpendicular to the extension of the handle portion 104 and/or the food manipulating portion 106.

The protrusion feature 142 may have one or more of a number of different features so as to indicate what the protrusion feature 142 represents. In this example, the protrusion feature 142 has two eyes 144 and a frill 145 so as to better define the protrusion feature 142 as the head of an Ankylosaurs.

The handle portion 104 could also include any one of a number of different protrusion features 128 extending upward from the handle portion. Here, the protrusion features 128 are generally represented as footprints that extend upward in a direction similar to that as the direction indicated by arrow 120. The protrusion features 128 may also comprise any number of desired shapes and designs, and may including a gripping surface and be comprised of a different material.

As best shown in FIG. 1B, the legs 108, 110, 112, and 114 may also contain protrusion features extending therefrom. Here, the legs 108, 110, 112, and 114 have footprint protrusion features 132, 134, 136, and 138 extending from each, respectively. The footprint protrusion features 132, 134, 136, and 138 may be configured so as to have gripping surfaces so as to better grip the surface 140. The protrusion features extending from the legs may comprise any design, and allow children to create footprints or other designs on a desired surface or in particular types of food. For instance children may create footprints, tracks or other designs in mashed potatoes.

The utensil 100 can be made of one type of material. However, the utensil 100 may also be made using a two-shot injection molding process so that different materials are utilized. For example, the body portion 102, the handle portion 104, and the food manipulating portion may be made of one type of material, while the protrusion features 128, 142, 130, 132, 134, 136, and/or 138 may be made of a second material.

So, more simply, the footprint protrusion features 128 along the handle portion 104, the eyes 144 of the head protrusion feature 142, the spike protrusion features 130, and the footprint protrusion features 132, 134, 136, and 138 may be made of a second material that could be softer than the material utilized to make the handle portion 104, body portion 102, and food manipulating portion 106. This may be advantageous because this allows for a user of the utensil 100 to better grip the utensil 100, especially if the previously described protrusion features are made of a material that is softer and more rubbery.

Additionally, because these protrusion features are made using a two-shot injection molding process, the utensil 100 could have one or more interior channels so that the protrusion features are in fluid communication with each other. The protrusion features 128, 144, 130, 132, 134, 136, 138, thus may all be fluidly connected to each other through a plurality of channels that generally extend through the body portion 102 and/or the handle portion 104.

Referring to FIGS. 2A-2D another example of the utensil 200 is shown. As stated before, like reference numerals will be utilized to refer to like elements and as such, the description previously provided in FIGS. 1A-1D are equally applicable here with the differences noted in the following paragraphs.

In this example, the utensil 200 has a food manipulating portion 206 that includes a plurality of tines 248 extending from a base portion 246. Essentially, the tines 248 as they extend from the base portion 246 so as to form the shape of a fork to manipulate food. In one embodiment, the tines 248 extend from the base portion 246 in a direction that flows out of the base portion 246 and generally proceeds along a plurality of perpendicular paths so as to define each of the tines 248. As such, while the tines 248 define a fork, they also have a look similar to that of a tail of a Stegosaurus.

Additionally, as the utensil 200 is in the shape of a Stegosaurus, the spike protrusion features 130 of the utensil 100 of FIGS. 1A-1D have been replaced with a different set of spikes generally arranged along two columns extending from the back of the body portion 202. The spikes 230 may be made of material that differs from the material of the body portion 202, handle portion 204, and food manipulating portion 206. As such, the spikes 230 may be in fluid communication with protrusions 228, 244, 232, 234, 236, and/or 238. The spikes may be configured in different alignments along the back of the body portion 202, may take different shapes and may take different heights and widths.

Like the example given in FIGS. 1A-1D, the utensil 200 when placed on a flat surface 240 has legs 208, 210, 212, and 214 that elevate the body portion 202, the handle portion 204 and/or the food manipulating portion 206 away from the surface 240 when the utensil 200 is placed on the flat surface so as the legs 208, 210, 212, and 214 can support the utensil 200. It should also be understood that this example may be modified so that the food manipulating portion 206 may be in contact with the surface 240.

Additionally, like before, the utensil 200 may have a protrusion feature 242 that generally extends along an axis 226. The handle portion 204 and the food manipulation portion 206 generally extend away from the body along the axis 224. As such, an angle 229 is formed between the axis 226 and the axis 224. The angle 229 from which the protrusion 242 extends may be any angle such as between 1 degree and 90 degrees.

Referring to FIGS. 3A-3D another example of the utensil 300 is shown. In this example, the utensil is generally shaped as a Triceratops and the food manipulating portion 306 is a flat surface or pusher 350 that allows the user of the utensil 300 to push food. As stated previously, like reference numerals have been utilized to refer to like elements. As such, the description provided previously is equally applicable to this example as well.

As stated before, the utensil 300 is shaped in the shape of a Triceratops and has a pusher 350 for the food manipulating portion 306. It should be understood that the pusher 350 of the food manipulating portion 306 could be replaced with another element that can manipulate food. As such, the pusher 350 could be replaced with a spoon, fork, spork, knife, and the like.

Here, the food manipulating portion 306 generally extends from a head 343. The head 343 is shaped as a Triceratops head having horns 352 that extend from a frill 345. Extending from the frill 345 may be a number of spike protrusion features 356 that may be extending radially from the frill 345.

The back of the body portion 302 may include a number of protrusion features 330. The protrusion features in this example are generally slightly muted bumps 330 that extend up indicated by arrow 320 of FIG. 3D. Like the spikes of the Stegosaurus of FIGS. 2A-2D and the spikes of the Ankylosaurs in FIGS. 1A-1D, the bumps 330 generally extend upward in a direction that is substantially perpendicular to the direction the handle portion 304 and the food manipulating portion 306 extends from the body portion 302. However, the protrusion features 330 may also comprise spikes or other features, and may extend from the body portion 302 in any number of directions.

Figure 3A:
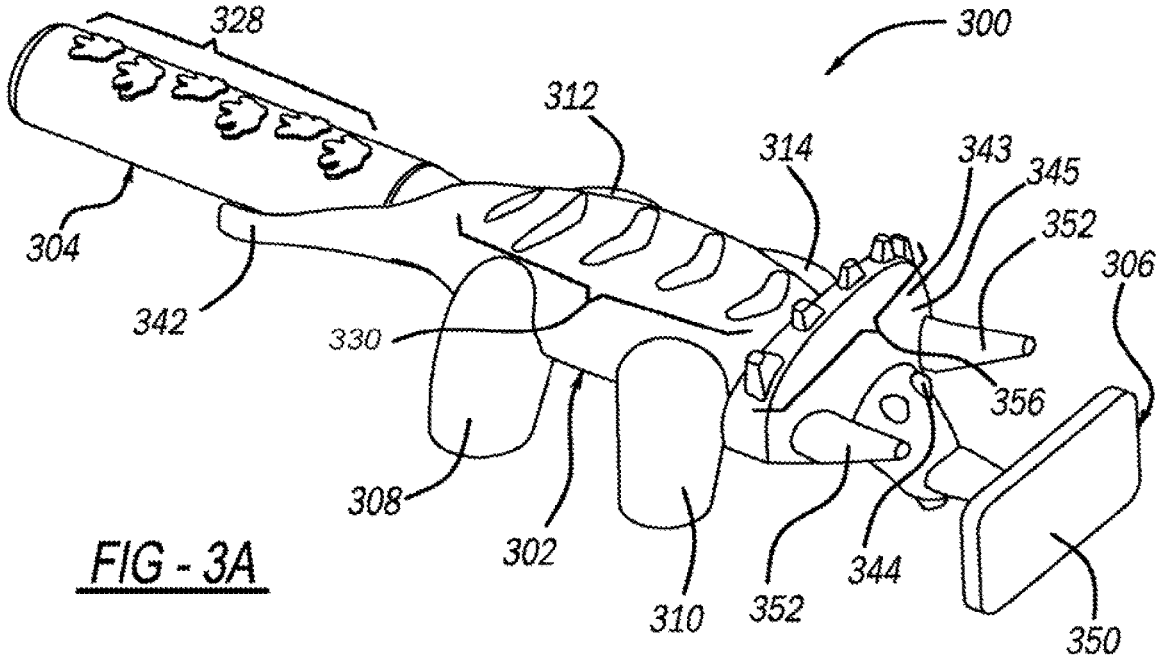
FIGS. 3A-3D illustrate yet another example of a utensil for interacting with food items with portions of the utensil shaped like a triceratops.
Figure 3B:
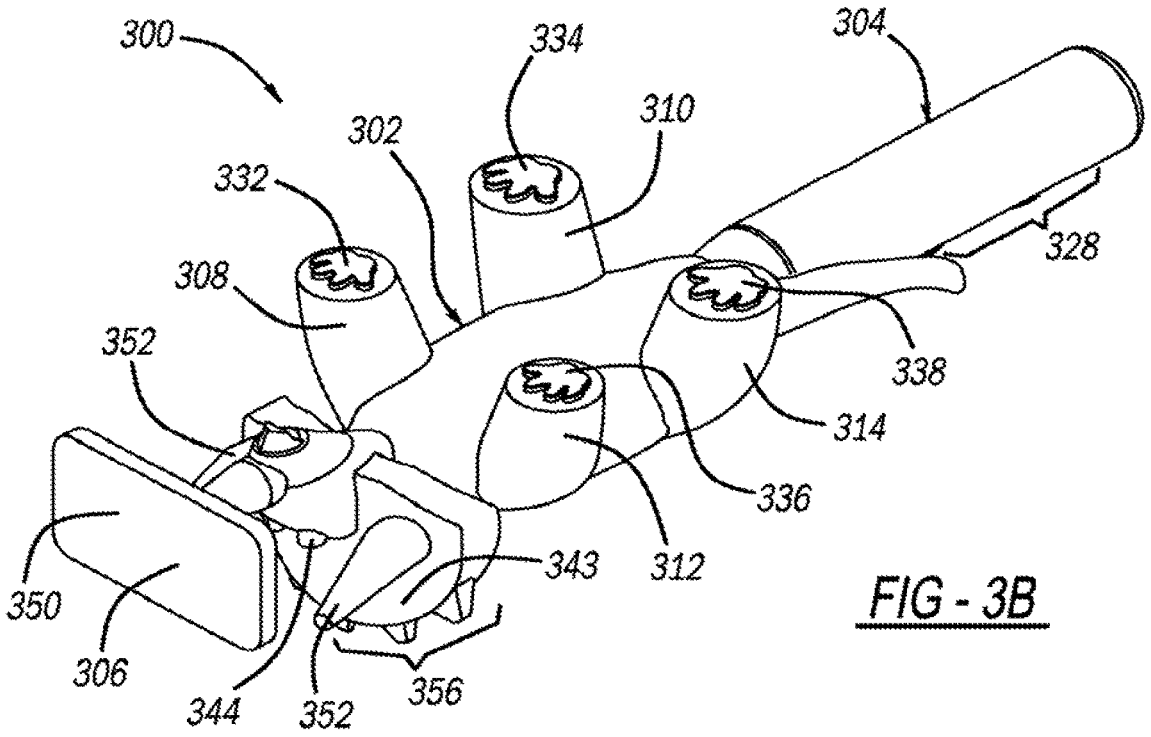
Figure 3C:
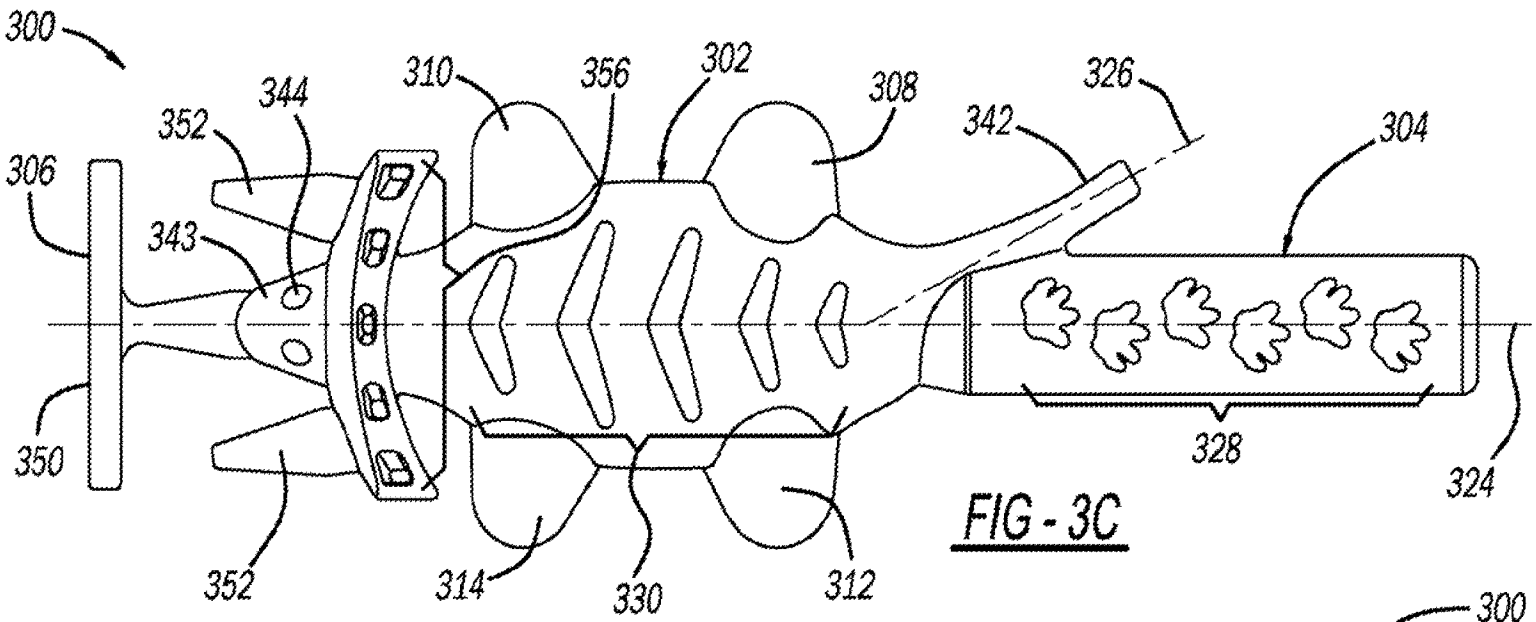

Additionally, the protrusion feature 342 that extends away from the body portion 302 of the utensil 300 may be shaped as a tail for the Triceratops. Here, the protrusion feature 342 extends along an axis 326, as best shown in FIG. 3C. The handle portion 304 and the food manipulating portion 306 generally extend along an axis 324. The axis 324 and the axis 326 generally define an angle that could be any angle. However, it should be understood that the angle would generally be between one degree and 90 degrees.

Figure 3D:
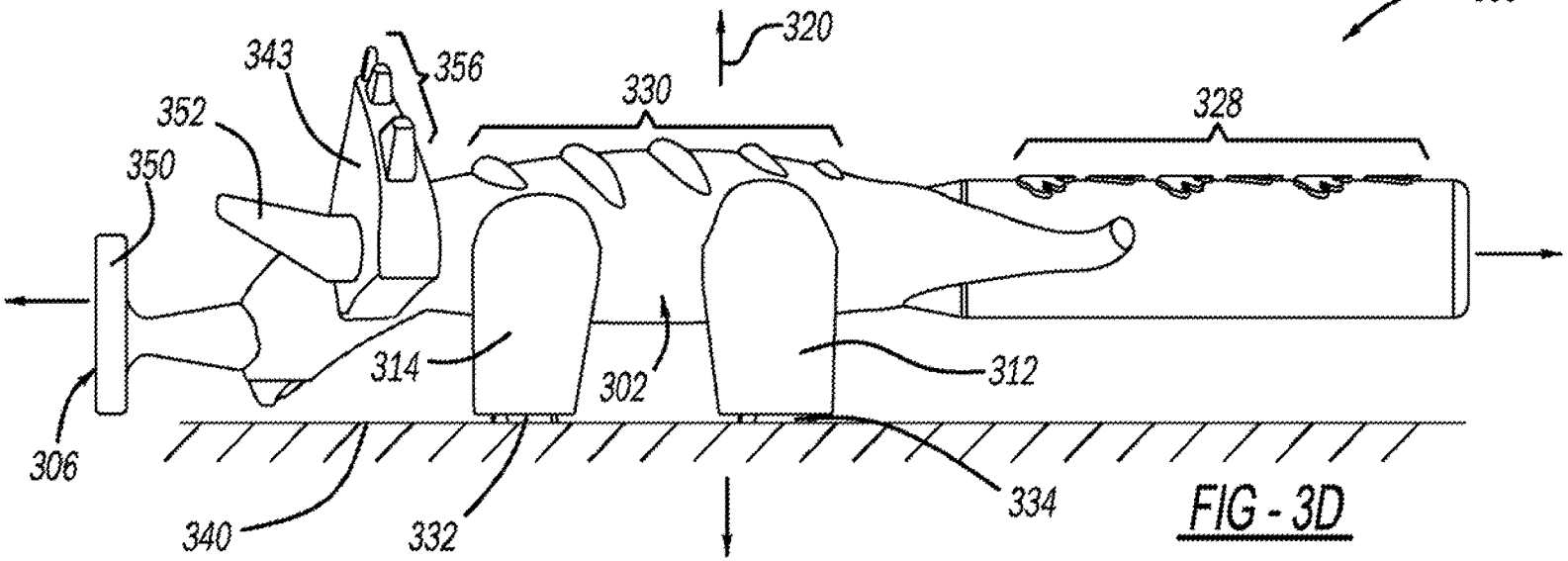

Like in the other examples, as best shown in FIG. 3D, when the utensil 300 is placed on a flat surface 340 with the leg protrusion features 308, 310, 312, and 314 used to support the utensil 300, the body portion 302, the handle portion 304, and/or the food manipulating portion 306 are elevated away from the surface 340 so as to prevent any food items that are attached to the utensil 300 from coming into contact with the surface 340. It should also be understood that this example may be modified so that the food manipulating portion 306 may be in contact with the surface 340.

Like as stated with the previous examples, the utensil 300 may be made of one material, but it may also be made of two separate types of material utilizing a two-shot injection molding process. As such, the handle portion 304, body portion 302, and food manipulating portion 306 may be made of one type of material but the protrusion features, such as protrusion feature 328, 312, 356, 344, 332, 334, 336, and/or 338 may be made of the second type of material that is fluidly connected to each other via channels located within the body portion 302 and/or the handle portion 304.

As a person skilled in the art will readily appreciate, the above description is meant as an illustration of an implementation of the principles of this invention. This description is not intended to limit the scope or application of this invention in that the invention is susceptible to modification, variation, and change, without departing from the spirit of this invention, as defined in the following claims.

What is claimed is:

1. A utensil configured to interact with food items, the utensil comprising:
- a main body portion having a rear end and a front end;
- a handle portion extending in a rearward direction from the rear end of the main body portion;
- a head portion extending in a forward direction from the front end of the main body portion, the head portion in the form of a head of an animal;
- a food manipulating portion extending in the forward direction from the head portion, wherein the food manipulating portion of the utensil is configured to interact with food;
- a transition region disposed between the head portion and the main body portion, wherein the transition region has a width narrower than the head portion and the main body portion; and
- a plurality of legs extending in a downward direction from the main body portion to support the utensil on a support surface, wherein the plurality of legs elevate the handle portion, the main body portion and the food manipulating portion from the support surface such that the handle portion, the main body portion, and the food manipulating portion are not in contact with the support surface when the utensil is placed on the support surface with the legs supporting the utensil from the support surface.

2. The utensil of claim 1, wherein the head portion includes the food manipulating portion.

3. The utensil of claim 1, further comprising a protrusion feature in the form of a body part of an animal formed on a surface of the utensil and being adjacent to the main body portion and extending laterally outward from the main body portion at an angle relative to the handle portion, wherein the angle is between 1 degree and 90 degrees, wherein the angle is measured within a plane that is substantially parallel to the support surface.

4. The utensil of claim 1, wherein the rearward direction defines a first axis, the forward direction extends along the first axis in an opposite direction relative to the rearward direction, and the downward direction is substantially perpendicular to the first axis.

5. The utensil of claim 1, further comprising at least one protrusion feature extending from either the main body portion, the head portion, or the handle portion.

6. The utensil of claim 5, wherein the protrusion feature extends upwardly or radially.

7. The utensil of claim 5, wherein the main body portion is made of a first material and the at least one protrusion feature is made of a second material, wherein the first material is different than the second material.

8. The utensil of claim 7, wherein the at least one protrusion feature comprises at least one body protrusion feature extending from the main body portion and at least one handle protrusion feature extending from the handle portion.

9. A utensil configured to interact with food items, the utensil comprising:
- a rear end of the utensil;
- a forward end of the utensil;
- a main body portion disposed between the rear end and the forward end;

a handle portion integrally formed with the main body portion and extending in a rearward direction from the main body portion, the rearward direction defining a first axis;

a food manipulating portion integrally formed with the main body portion and disposed at the forward end of the utensil, wherein the food manipulating portion of the utensil is configured to interact with food;

a plurality of legs extending downwardly from the main body portion to support the utensil on a support surface, the plurality of legs having lower ends that combine to define a support plane; and a protrusion feature formed on a surface of the utensil and being adjacent to the main body portion and extending outwardly from the main body portion at a second axis, wherein an angle between the first axis and the second axis is between 1 degree and 90 degrees, wherein the angle between the first axis and the second axis is measured within a plane that is substantially parallel to the support plane.

10. The utensil configured to interact with food items of claim 9, wherein the protrusion feature is in the form of a body part of an animal.

11. The utensil configured to interact with food items of claim 9, wherein the protrusion feature is at least partially between the main body portion and the handle portion.

12. The utensil configured to interact with food items of claim 9, wherein the angle between the first axis and the second axis is between 5 degrees and 45 degrees.

13. A utensil comprising:

a rear end of the utensil;

a forward end of the utensil;

a main body portion disposed between the rear end and the forward end;

a handle portion integrally formed with the main body portion and extending in a rearward direction from the main body portion, the rearward direction defining a first axis;

a food manipulating portion integrally formed with the main body portion and disposed at the forward end of the utensil, wherein the food manipulating portion of the utensil is configured to interact with food;

a transition region disposed between the food manipulating portion and the main body portion, wherein the transition region has a width narrower than the food manipulating portion and the main body portion;

a support structure extending downwardly from the main body portion to support the utensil on a support surface, the support structure having a lower end that defines a support plane; and a body part portion integrally formed with the food manipulating portion and the main body portion, the body part portion being disposed forward relative to the main body portion, the body part portion being in the form of a head or a tail of an animal.

14. The utensil of claim 13, wherein the support structure elevates the main body portion, the handle portion, and the food manipulating portion relative to the support surface.

15. The utensil of claim 13, further comprising a protrusion feature extending laterally outward from the main body portion or the handle portion at an angle relative to the handle portion, wherein the angle is between 1 and 90 degrees, wherein the angle is measured in a plane that is parallel to the support plane.

16. The utensil of claim 15, wherein the protrusion feature is a tail, and the food manipulating portion is part of the body part portion, wherein the body part portion that extends from the main body portion, wherein the body part portion is in the form of a head of animal.

17. The utensil of claim 15, wherein the protrusion feature is a head of an animal, and the food manipulating portion is part of the body part portion, wherein the body part portion that extends from the main body portion, wherein the body part portion is in the form of a tail of an animal.

18. The utensil of claim 13, wherein the body part portion is in the form of a tail of an animal, and the tail includes the food manipulating portion.

19. The utensil of claim 13, wherein the body part portion is in the form of a head of an animal, and the head includes the food manipulating portion.

20. A utensil comprising:

a rear end of the utensil;

a forward end of the utensil;

a main body portion disposed between the rear end and the forward end;

a handle portion integrally formed with the main body portion and extending in a rearward direction from the main body portion, the rearward direction defining a first axis;

a food manipulating portion integrally formed with the main body portion and disposed at the forward end of the utensil, wherein the food manipulating portion of the utensil is configured to interact with food;

a transition region disposed between the food manipulating portion and the main body portion, wherein the transition region has a width narrower than the food manipulating portion and the main body portion; and a support structure extending downwardly from the main body portion to support the utensil on a support surface, the support structure having a lower end that defines a support plane;

wherein the transition region that is disposed between the food manipulating portion and the main body portion tapers down in a forward direction from the main body portion, such that a rearward end of the transition region is wider than a forward end of the transition region.

* * * * *